US011089913B2

(12) United States Patent
McNulty et al.

(10) Patent No.: US 11,089,913 B2
(45) Date of Patent: Aug. 17, 2021

(54) DOUBLE INLET VALVE FOR ENHANCED PUMP EFFICIENCY

(71) Applicant: GOJO Industries, Inc., Akron, OH (US)

(72) Inventors: John J. McNulty, Broadview Heights, OH (US); Donald R. Harris, Mogadore, OH (US); Aaron D. Marshall, Uniontown, OH (US); Daniel M. Willis, Clinton, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 16/175,957

(22) Filed: Oct. 31, 2018

(65) Prior Publication Data

US 2019/0133383 A1 May 9, 2019

Related U.S. Application Data

(60) Provisional application No. 62/581,820, filed on Nov. 6, 2017.

(51) Int. Cl.
*A47K 5/12* (2006.01)
*F04B 53/10* (2006.01)
(Continued)

(52) U.S. Cl.
CPC ..... *A47K 5/1207* (2013.01); *A47K 5/1208* (2013.01); *A47K 5/1209* (2013.01);
(Continued)

(58) Field of Classification Search
CPC .. A47K 5/1207; A47K 5/1208; A47K 5/1209; A47K 5/1211; A47K 5/1217;
(Continued)

(56) References Cited

U.S. PATENT DOCUMENTS 1,380,415 A 6/1921 Putnam
3,952,918 A * 4/1976 Poitras ..... B67B 7/28 222/82

(Continued)

FOREIGN PATENT DOCUMENTS

JP 06-009977 Y 3/1994
WO 2011144861 A1 11/2011

OTHER PUBLICATIONS

International Search Report and Written Opinion from PCT/US2018/058448 dated Feb. 22, 2019 (14 pages).

*Primary Examiner* — Vishal Pancholi
*Assistant Examiner* — Robert K Nichols, II
(74) *Attorney, Agent, or Firm* — Calfee, Halter & Griswold LLP

(57) ABSTRACT

An dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the first check valve has a first cracking pressure. The second check valve is disposed between the first check valve and the pump, and the second check valve has a second cracking pressure. The first cracking pressure of the first check valve is greater than the second cracking pressure of the second check valve.

18 Claims, 2 Drawing Sheets

(51) Int. Cl.

| | |
|---|---|
| ***B05B 11/00*** | (2006.01) |
| ***F04B 43/00*** | (2006.01) |
| ***F04B 19/22*** | (2006.01) |
| ***F04B 43/02*** | (2006.01) |

(52) U.S. Cl.
CPC ..... *A47K 5/1211* (2013.01); *A47K 5/1217* (2013.01); *B05B 11/3071* (2013.01); *F04B 19/22* (2013.01); *F04B 43/00* (2013.01); *F04B 43/02* (2013.01); *F04B 53/1002* (2013.01); *B05B 11/3069* (2013.01)

(58) Field of Classification Search
CPC . A47K 5/12; F04B 19/22; F04B 43/00; F04B 43/02; F04B 53/1002; B05B 11/3071; B67D 1/06; B67D 3/0029; F16K 15/00; F16K 15/186; F16K 15/188
USPC ..... 222/173, 181.1, 181.2, 181.3, 491, 496, 222/190, 321.3, 375, 394
See application file for complete search history.

(56) References Cited

U.S. PATENT DOCUMENTS

| | | | | |
|---|---|---|---|---|
| 5,004,123 | A * | 4/1991 | Stoody ..... | B05B 11/00412 222/94 |
| 5,390,814 | A | 2/1995 | Christine et al. | |
| 5,469,990 | A | 11/1995 | Wodeslavsky | |
| 2002/0125271 | A1 | 9/2002 | Zeitlin | |
| 2006/0249536 | A1 | 11/2006 | Hartman et al. | |
| 2008/0135578 | A1 | 6/2008 | Ophardt | |
| 2013/0206794 | A1 | 8/2013 | McNulty | |
| 2014/0252042 | A1 | 9/2014 | Cittadino | |
| 2017/0156550 | A1 * | 6/2017 | Ciavarella ..... | A47K 5/14 |

* cited by examiner

DOUBLE INLET VALVE FOR ENHANCED PUMP EFFICIENCY

RELATED APPLICATIONS

This application claims priority to and the benefits of U.S. Provisional Application Ser. No. 62/581,820, titled DOUBLE INLET VALVE FOR ENHANCED PUMP EFFICIENCY, which was filed on Nov. 6, 2017 and which is incorporated herein by reference in its entirety.

BACKGROUND

Dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Dispenser systems often use a pump to pump liquid from a container and into the hand of a user.

SUMMARY

An exemplary dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the first check valve has a first cracking pressure. The second check valve is disposed between the first check valve and the pump, and the second check valve has a second cracking pressure. The first cracking pressure is greater than the second cracking pressure.

Another exemplary dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the second check valve is disposed between the first check valve and the pump. Movement of the pump chamber from the compressed position to the expanded position causes the first check valve to move to an open position such that a portion of the liquid moves from the container past the first check valve and causes the second check valve to open such that a portion of the liquid moves from the container past the second check valve and into the pump chamber. Movement of the pump chamber from the expanded position to the compressed position causes the first check valve to maintain a closed position such that liquid is prevented from moving from the container and into the pump chamber. The movement of the pump chamber from the expanded position to the compressed position also causes the second check valve to maintain a closed position such air cannot move into and be compressed in a space between the container and the second check valve.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

Figure 1:
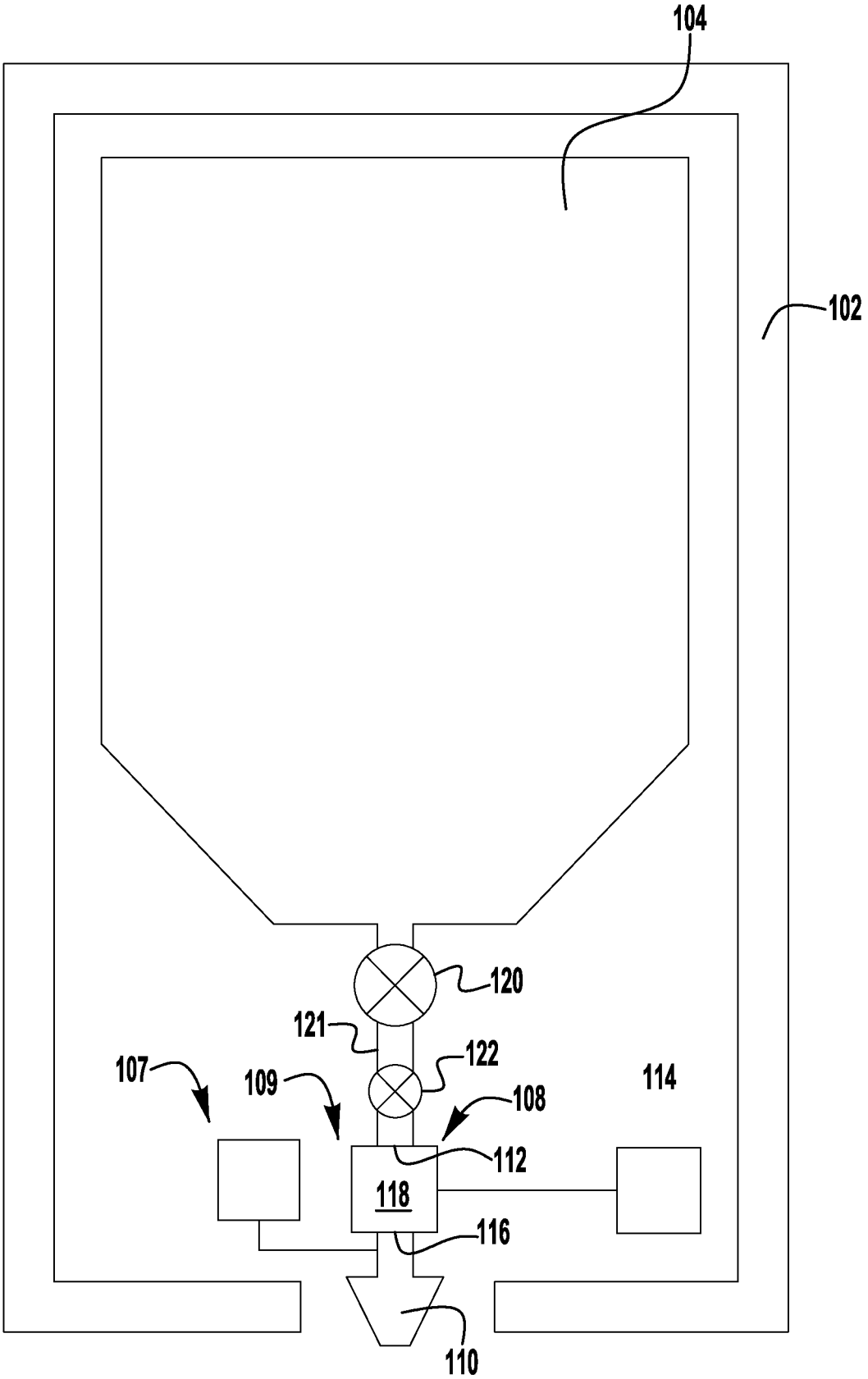
FIG. 1 is a cross-sectional view of an exemplary embodiment of a dispenser.

FIG. 1 illustrates an exemplary dispenser 100 having a housing 102, a container 104 for holding a liquid, a pump 108, a first check valve 120, a second check valve 122, and a dispenser outlet 110. The first check valve 120, a second check valve 122 are located upstream of the liquid inlet of the pump 108. The pump 108 is configured to pump the liquid from the container 104 through the outlet 110. In some embodiments, the liquid can be, for example, soap, a concentrated soap, a sanitizer, a lotion, a moisturizer or the like. The pump 108 may be, for example, a displacement pump, such as, for example, a piston pump, a diaphragm pump, a rotary pump, or the like. In certain embodiments, the pump 108 may be a sequentially activated multi-diaphragm foam pump. Exemplary embodiments of sequentially activated multi-diaphragm pumps are shown and disclosed in: U.S. Non-Provisional application Ser. No. 15/429,389 filed on Feb. 10, 2017 and titled HIGH QUALITY NON-AEROSOL HAND SANITIZING FOAM; U.S. Non-Provisional application Ser. No. 15/369,007 filed on Dec. 5, 2016 and titled SEQUENTIALLY ACTIVATED MULTI-DIAPHRAGM FOAM PUMPS, REFILL UNITS AND DISPENSER SYSTEMS; U.S. Non-Provisional patent application Ser. No. 15/355,112 filed on Nov. 18, 2016 and titled SEQUENTIALLY ACTIVATED MULTI-DIAPHRAGM FOAM PUMPS, REFILL UNITS AND DISPENSER SYSTEMS; U.S. Non-Provisional application Ser. No. 15/350,190 filed on Nov. 14, 2016 and titled IMPROVED FOAMING CARTRIDGE; U.S. Non-Provisional application Ser. No. 15/356,795 filed on Nov. 21, 2016 and titled FOAM DISPENSING SYSTEMS, PUMPS AND REFILL UNITS HAVING HIGH AIR TO LIQUID RATIOS; and U.S. Non-Provisional application Ser. No. 15/480,711 filed on Apr. 6, 2017 and titled FOAM DISPENSING SYSTEMS, PUMPS AND REFILL UNITS HAVING HIGH AIR TO LIQUID RATIOS; each of which are incorporated herein in their entirety.

In some exemplary embodiments, the pump 108 may be a foam pump that includes a liquid pump 109 and an air pump 107. In some embodiments, the air pump and liquid pump portions are integrated into a single pump. In some embodiments, the pump 108 is a split pump and the liquid pump portion is connected to the container as a single unit that may be replaced. In an exemplary embodiment, the liquid pump portion separates from the air pump portion, which remains with the housing. Accordingly, as used herein, pump 108 may be a liquid pump or a foam pump and may have many different configurations and should not be limited to the illustrated examples.

In some exemplary embodiments, the dispenser 100 may include a foam cartridge (not shown). In certain of these exemplary embodiments, a liquid pump 109 pumps liquid from the container into a mixing chamber (not shown) and the air pump 107 pumps air into the mixing chamber (not shown) to mix with the liquid, and the liquid-air mixture travels through the foam cartridge to create a rich foam. Exemplary embodiments of foam pumps are shown and described in, U.S. Pat. No. 7,303,099 titled Stepped Pump Foam Dispenser; U.S. Pat. No. 8,002,150 titled Split Engagement Flange for Soap Piston; U.S. Pat. No. 8,091,739 titled Engagement Flange for Fluid Dispenser Pump Piston; U.S. Pat. No. 8,113,388 titled Engagement Flange for Removable Dispenser Cartridge; U.S. Pat. No. 8,272,539, Angled Slot Foam Dispenser; U.S. U.S. Pat. No. 8,272,540 titled Split Engagement Flange for Soap Dispenser Pump Piston; U.S. Pat. No. 8,464,912 titled Split Engagement Flange for Soap Dispenser Pump Piston; U.S. Pat. No. 8,360,286 titled Draw Back Push Pump; U.S. Provisional Pat. Ser. No. 62/293,931 titled High Quality Non-Aerosol Hand Sanitizing Foam; U.S. Provisional Pat. Application Ser. No. 62/257,008 titled Sequentially Activated Multi-Diaphragm Foam Pumps, Refill Units and Dispenser Systems; U.S. Pat. No. 8,172,555 titled Diaphragm Foam Pump; U.S. 2008/0,277,421 titled Gear Pump and Foam Dispenser, all of which are incorporated herein by reference in their entirety. These exemplary foam pumps may be converted to liquid pumps by removing the air pump components. Exemplary embodiments of foam cartridges 134 are shown and described in U.S. Publication No. 2014/0367419 titled Foam Cartridges, Pump, Refill Units and Foam Dispensers Utilizing The Same, which is incorporated herein by reference in its entirety.

In various embodiments, the dispenser 100 is a "touch free" dispenser and includes an actuator 114 that activates the pump 108 to pump liquid from the container 104 and out of the nozzle 110 of the dispenser 100. Exemplary touch-fee dispensers are shown and described in U.S. Pat. No. 7,837,066 titled Electronically Keyed Dispensing System And Related Methods Utilizing Near Field Response; U.S. Pat. No. 9,172,266 title Power Systems For Touch Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hans-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all which are incorporated herein by reference. In embodiments that include a touch-free feature, the dispenser 100 may include a power source (not shown), a sensor (not shown), a controller (not shown), and a motor (not shown). The power source is in electrical communication with and provides power to the sensor, controller, and motor. The power source may be an internal power source, such as, for example, one or more batteries or an external power source, such as, for example, solar cells, or a conventional 120 VAC power supply. In some embodiments, a multiple power supplies are included, such as, for example, batteries and solar cells.

In various embodiments, the dispenser is a manual dispenser. In such embodiments, the actuator 114 may require manual activation, such as, for example, a user engages a push bar, a user engages a foot pedal, a pushbutton, or the like. In some embodiments that require manual activation, a push bar (not shown) is mechanically coupled to the actuator 114 and, when a user engages the push bar, the actuator 114 causes liquid from the container 104 to be pumped through the nozzle 110 of the dispenser 100.

Still referring to FIG. 1, an exemplary embodiment of a pump 108 includes a pump inlet 112, a pump outlet 116, and a pump chamber 118. The pump inlet 112 is in fluid communication with the container 104 such that the pump inlet can receive liquid from the container 104. The pump chamber 118 is in fluid communication with the pump inlet 112 such that the pump chamber can receive liquid from the container 104 through the pump inlet 122. The pump outlet 116 is in fluid communication with the pump chamber 118 and with the nozzle 110 such that the pump 108 can pump liquid from the pump chamber through the pump outlet 116 and the nozzle 110. In certain embodiments, the pump 108 is a positive displacement pump such that movement of the pump chamber 118 between an expanded position and a compressed position causes the pump to pump liquid through the nozzle 110 of the dispenser 100 and to move liquid from the container and into the pump chamber. In certain embodiments, the pump chamber 118 has a small volume. In certain embodiments, the volume of pump chamber 118 is between about 0.2 cc and about 0.5 cc when the pump chamber is in the expanded position.

The dispenser 100 includes a first check valve 120 and a second check valve 122. Both the first check valve 120 and the second check valve 122 are located in-line between the container 104 and the pump 108. The first check valve 120 is a normally closed valve and it prevents liquid from entering the pump chamber 118 when the first check valve is in a closed position. The first check valve 120 also prevents fluid from flowing from the pump 108 back up into the container 104. First check valve 120 moves to an open position when a sufficient cracking pressure is present between the pump 108 and the first check valve 120. Movement of the first check valve 120 from the closed position to an open position allows liquid to flow from the container 104, into the area 121 between the first check valve 120 and the second check valve 122 and past first check valve 120 into pump chamber 118. Movement of the first check valve 120 from the open position back to the closed position prevents the liquid in the container 104 from entering the pump chamber 118. In various embodiments, the first check valve 120 is a high flow valve that is configured to prevent static drip of liquid from the container 104 through the pump 108 when the first check valve 120 is in the closed position. The first check valve 120 may be, for example, a ball and spring valve, a mushroom valve, a flapper valve, and the like. In some embodiments, first check valve 120 has a cracking pressure of at least about 0.5 psi. In some embodiments, first check valve 120 is a slow reacting check valve and is configured to hold back head pressure from the container.

The second check valve 122 is disposed between the first check valve 120 and the pump 108. In certain embodiments, the second check valve 122 is disposed adjacent to the pump chamber 118 of the pump 108. The second check valve 122 is configured to limit the volume of the pump chamber. In some embodiments, the limited volume prevents air from being compressed in the area between the container 104 and the pump 108 which tends to preventing or inhibiting the upstream vacuum pressure, which may occur during, for example, priming and use of the dispenser 100. The second check valve 122 is moved to an open position by vacuum pressure created in the pump chamber 118. Movement of the second check valve 122 from the closed position to the open position allows liquid to flow from the container 104, past the first check valve 120 and into the pump chamber 118, and movement of the second check valve 122 from the open position to the closed position prevents air or liquid from flowing from the pump chamber 118 back towards the container 104.

Without second check valve 122, when a small pump chamber 118 is used, compression and expansion of the pump chamber 118 may merely cause compression/decompression of air between the pump chamber 118 and first check valve 120 without opening the first check valve 120 thereby never priming pump chamber 118. In certain embodiments, the second check valve 122 is a high flow, fast acting valve. In some embodiments, second check valve 122 has minimal cracking pressure. In some embodiments, the cracking pressure is between about 0 and about 2 psi. Second check valve 122 is fast acting and in certain embodiments closes in less than about 0.1 second. The second check valve 122 may be, for example, an umbrella valve, a duckbill valve, a flapper valve, and the like. In certain embodiments, the second check valve 122 is a normally-open valve. In alternative embodiments, the second check valve 122 is a normally-closed valve. The first check valve 120 has a greater cracking pressure than the second check valve 122.

To operate the dispenser 100, a user activates the pump 108 using the actuator 114, which causes liquid to move from the pump chamber 118, through the nozzle 110, and into a hand of the user. In certain embodiments, the pump 108 includes a liquid pump portion 109 (that includes the pump chamber 118) and an air pump portion 107. In these embodiments, the liquid pump portion pumps 109 pumps liquid from the container 104, the air pump portion 107 pumps air, and the liquid and air mix to form a foamy mixture. In alternative embodiments, the dispenser 100 is a liquid dispenser that has a pump 108 that only includes a liquid pump portion 109.

The activation of the pump 108 causes the pump chamber 118 to move from an expanded position to a compressed position. When the pump chamber 118 compresses, check valve 122 closes preventing fluid from flowing into the space between check valve 120 and check valve 122. This movement from the expanded position to the compressed position forces liquid in the pump chamber 118 to move through the pump outlet 116 and out a nozzle 110 of the dispenser. During this movement of the pump chamber 118 from the expanded to the compressed position, the second check valve 122 closes very fast and maintains a closed position preventing air in the passage between the container 104 and the pump chamber 118 from compressing/uncompressing thus preventing the pump 108 from operating properly. After the liquid is dispensed through the nozzle 110, the pump chamber 118 moves back to an expanded position, which creates a negative pressure in the pump chamber 118. This negative pressure creates a vacuum pressure that causes the first check valve 120 and the second check valve 122 to move from a closed position to an open position. The movement of the first check valve 120 and second check valve 120 to the open position allows liquid from the container 104 to flow past the first and second check valves 120, 122, through the pump inlet 112 and into the pump chamber 118. The second check valve 122 must be fast acting and is advantageous because without it, air being compressed between the container 104 and the pump 108 may prevent the pump chamber 118 from being sufficiently filled with liquid from the container 104 during operation of pump 108, and in particularly during priming of the pump 108, which would cause the pump 108 to be less efficient or not work at all.

Figure 2:
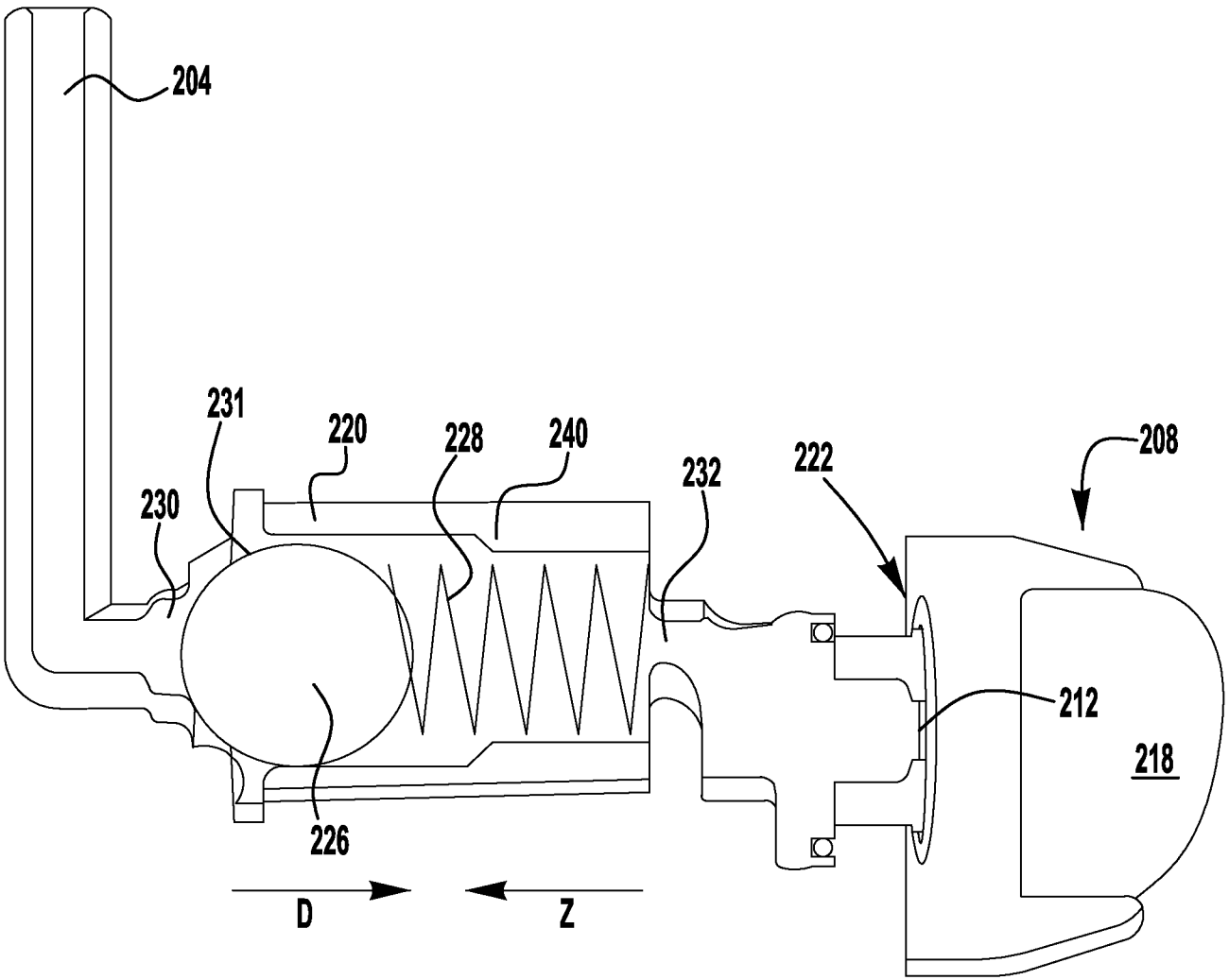
FIG. 2 is a partial cross-sectional view of another exemplary embodiment of a portion of a dispenser.

Referring to FIG. 2, another exemplary embodiment of a double acting valve portion of a dispenser 200 includes an inlet 204 that is connected to a container (not shown), a pump 208, a first check valve 220, and a second check valve 222. The pump 208 includes a pump inlet 212, a pump outlet (not shown), and a pump chamber 218. The pump chamber 218 is movable between an expanded position and a compressed position. In certain embodiments, the pump chamber 218 is a small pump chamber. In certain embodiments, pump chamber 218 has a volume between about 0.2 cc and about 0.5 cc when the pump chamber is in the expanded position.

The first check valve 220 and the second check valve 222 are disposed between the inlet 204 from the container and the pump 208. The first check valve 220 includes an inlet 230, an outlet 232, a ball 226, and a biasing member 228 (e.g., a spring). The first check valve 220 is movable between an open position and a closed position. The first check 220 valve is in the closed position when the ball 226 engages the seal 231 of inlet 230, and the first check valve 220 is in the open position when the ball 226 is moved away from the seal 231 in the direction D allowing fluid flow. In certain embodiments, the first check valve 220 is a normally closed valve, in which the biasing member 228 exerts a force on the ball 226 in the direction Z that causes the first check valve 220 to maintain the closed position. When the first check valve 220 is in the closed position, liquid from the inlet 204 is prevented from moving through the inlet 230 and the outlet 232 of the first check valve 220. In some embodiments, first check valve 220 has a cracking pressure that is greater than the head pressure in the container. The first check valve 220 moves to an open position when sufficient vacuum pressure is developed in the system downstream of first check valve 220. Movement of the ball in the direction D moves the first check valve 220 to the open position and allows liquid from the inlet 204 to move through the check valve inlet 230 and the outlet 232 of the first check valve 220, through the second check valve 222, and into chamber 218 of the pump 208. In certain embodiments, the first check valve 220 is a high flow valve that is configured to prevent static drip of liquid from the inlet 204 into the pump 208 when the first check valve 220 is in the closed position.

The second check valve 222 is disposed between the first check valve 220 and the pump 208. In certain embodiments, the second check valve 222 is disposed adjacent to the pump chamber 218 of the pump 208. The second check valve 222 is configured to prevent air from being compressed between the pump 208 and the first check valve 220 during priming and use of the dispenser 200. Dispensers not having the second check valve 222 may have air being compressed/uncompressed in a space between (e.g., space 240 of the first check valve 220) that is between the inlet 230 and the pump 208. The second check valve 222 prevents air from being compressed/uncompressed in space 240. Movement of the second check valve 222 from the closed position to the open position allows liquid to flow from the container (not shown), through first check valve 220 and into the pump chamber 218, and movement of the second check valve 222 from the open position to the closed position prevents fluid from flowing past the second check valve 22 toward the container. It also limits the volume of the pump chamber 218 and prevents air from being compressed/uncompressed between the inlet 230 and the pump 208. In certain embodiments, the second check valve 222 is a high flow, fast acting valve. The second check valve 222 can be, for example, an umbrella valve, a duckbill valve, a flapper valve, or the like. In certain embodiments, the second check valve 222 is a normally-open valve. In alternative embodiments, the second check valve 222 is a normally-closed valve. In certain embodiments, the second check valve 222 has a minimal cracking pressure, such that pressure from the movement of the liquid causes the second check valve to move to an open position.

In certain embodiments, the first check valve 220 has a greater cracking pressure than the second check valve 222. In various embodiments, the first check valve 220 can have a cracking pressure between about 0.5 psi and about 3 psi. The second check valve 222 can have a cracking pressure between about 0 psi and about 2 psi.

To operate the dispenser 200, a user activates the pump 208, which causes the pump chamber 218 to move from an expanded position to a compressed position. This movement from the expanded position to the compressed position forces liquid in the pump chamber 218 to move through the pump outlet and into a hand of the user. During this movement of the pump chamber 118 from the expanded to the compressed position, the second check valve 222 maintains a closed position. After the liquid is moved through the pump outlet 216, the pump chamber 218 moves back to the expanded position, which creates a vacuum pressure in the pump chamber 218. This vacuum pressure creates a suction that causes the ball 226 of the first check valve 220 to move in the direction D, which causes the first check valve 220 to be in an open position, and allows liquid to flow past the second check valve 222 and enter the pump chamber 218 to prime the pump 208. The second check valve 222 is advantageous because air entering the pump chamber 218 during priming of the pump 208 may prevent the pump chamber 218 from being sufficiently filled with liquid from the inlet 204, which would cause the pump 208 to be less efficient or not work at all.

The first check valve 220 remains in the open position until there is no longer a vacuum pressure in the pump chamber 218 that exceeds the cracking pressure of the first check valve 220. Once the pump chamber 218 no longer has a vacuum pressure that is higher than the cracking pressure, the biasing member 228 forces the ball 226 to move in the direction Z such that the first check valve 220 is in a closed position. When the first check valve 220 is in the closed position, the liquid from the inlet 204 is prevented from entering the chamber 218 of the pump 208. The pump 208 is in a primed position when the pump chamber 218 is filled with liquid, and the first check valve 220 is in the closed position. After the pump 208 is in the primed position, the dispenser 200 is ready for use by a user, and the cycle for operating the dispenser 200 described above is used to dispense liquid from the dispenser.

The exemplary embodiments of the pumps, first check valves, and second check valves described herein can be part of a replaceable refill unit for a dispenser, or can be fixed to the housing of a dispenser. In addition, the exemplary first and second check valves described herein can be disposed within the housing of the pump, or can be separate from the pump.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A dispenser comprising:

a housing;

a container disposed in the housing for holding a liquid;

a nozzle; and a pump disposed between the container and the nozzle, the pump having:

a pump inlet in fluid communication with the container;

a pump outlet in fluid communication with the nozzle;

a pump chamber in fluid communication with the pump inlet and the pump outlet, wherein the pump chamber is movable between an expanded position and a compressed position;

a first normally closed check valve disposed between the container and the pump, wherein the first normally closed check valve has a first cracking pressure;

the first normally closed check valve is located below the container and has a cracking pressure that is higher than a head pressure created by fluid in the container; and a second normally closed check valve located below the container and disposed between the first normally closed check valve and the pump, wherein the second normally closed check valve has a second cracking pressure;

wherein the first cracking pressure of the first normally closed check valve is greater than the second cracking pressure of the second normally closed check valve; and both the first and second cracking pressures are greater than zero.

2. The dispenser of claim 1, the first normally closed check valve has a first action rate and the second normally closed check valve as a second actuation rate, and wherein the second actuation rate is faster than the first actuation rate.

3. The dispenser of claim 1, wherein the first normally closed check valve is a ball and spring valve.

4. The dispenser of claim 1, wherein the pump is a piston pump.

5. The dispenser of claim 1, wherein the pump is a diaphragm pump.

6. The dispenser of claim 1, wherein the pump is a sequentially activated diaphragm pump, wherein a first diaphragm of the sequentially activated diaphragm pump comprises the pump chamber.

7. The dispenser of claim 1, wherein the pump chamber has a volume of between about 0.22 cc and about 0.5 cc when the pump chamber is in the expanded position.

8. The dispenser of claim 1, wherein the first cracking pressure is between about 0.5 psi and about 3 psi.

9. The dispenser of claim 1, wherein the second cracking pressure is between about 0 psi and about 2 psi.

10. A dispenser for dispensing soap, sanitizer or lotion comprising:

a housing;

a container disposed in the housing holding a soap, a sanitizer or a lotion; and a pump disposed between the container and the nozzle, the pump having:

a pump inlet in fluid communication with the container;

a pump chamber in fluid communication with the pump inlet and the pump outlet, wherein the pump chamber is movable between an expanded position and a compressed position;

a first normally closed check valve located below the container and disposed between the container and the pump;

the first check valve having a cracking pressure of greater than about 0.5 psi;

the first normally closed check valve has a cracking pressure that is higher than a head pressure created by fluid in the container;

a second normally closed check valve located below the container and disposed between the first check valve and the pump;

the second normally closed check valve having a cracking pressure that is greater than zero and less than about 0.5 psi.

11. The dispenser of claim 10, wherein the first normally closed check valve is a ball and spring valve.

12. The dispenser of claim 10, wherein the second normally closed check valve is a flapper valve.

13. The dispenser of claim 10, wherein the pump is a diaphragm pump.

14. The dispenser of claim 10, wherein the pump chamber has a volume of between about 0.2 cc and about 0.5 cc when the pump chamber is in the expanded position.

15. A dispenser for dispensing soap, sanitizer or lotion comprising:

a housing;

a container located within the housing holding a soap, a sanitizer or a lotion; and a first normally closed check valve located downstream of the container;

the first normally closed check valve is located below the container and has a cracking pressure that is higher than a head pressure created by fluid in the container;

a second normally closed check valve located below the container and downstream of the first normally closed check valve;

the second normally closed check valve having a cracking pressure that is greater than zero and lower than cracking pressure of the first normally closed check valve; and a pump, the pump having:

a pump inlet downstream of the second normally closed check valve;

a pump chamber in fluid communication downstream of the pump inlet and a pump outlet;

wherein the pump chamber is movable between an expanded position and a compressed position.

16. The dispenser of claim 15 a wherein the first cracking pressure is between about 0.5 psi and about 3 psi.

17. The dispenser of claim 15, wherein the second cracking pressure is between about 0 psi and about 2 psi.

18. The dispenser of claim 15 wherein the second check valve has a cracking pressure that is low enough that absent the first normally closed check valve, fluid would flow out of the container past the second check valve.

* * * * *